US005486089A

United States Patent [19]

Chung

[11] Patent Number: 5,486,089

[45] Date of Patent: Jan. 23, 1996

[54] DIRECTIONAL CHANGEOVER PUMP

[75] Inventor: Ui-Shik Chung, Incheon, Rep. of Korea

[73] Assignee: Daewoo Electronics Co., Ltd., Seoul, Rep. of Korea

[21] Appl. No.: 290,455

[22] Filed: Aug. 15, 1994

[30] Foreign Application Priority Data

Feb. 28, 1994 [KR] Rep. of Korea ..... 94-3822

[51] Int. Cl.[6] ..... F04D 1/00

[52] U.S. Cl. ..... 415/146; 415/911; 417/442

[58] Field of Search ..... 415/146, 911; 417/442; 137/118, 119

[56] References Cited

U.S. PATENT DOCUMENTS

| | | | |
|---|---|---|---|
| 2,566,609 | 9/1951 | Grosse | 137/118 |
| 2,992,652 | 7/1961 | Fellberg | 137/118 |
| 4,653,977 | 3/1987 | Fries | 415/146 |
| 4,728,260 | 3/1988 | Ishii | 417/442 |
| 4,869,076 | 9/1989 | Sakai et al. | 415/911 |
| 4,874,298 | 10/1989 | Mainardi et al. | 417/442 |
| 4,900,235 | 2/1990 | Perkins et al. | 417/442 |
| 5,344,293 | 9/1994 | Mota et al. | 415/911 |

FOREIGN PATENT DOCUMENTS

| | | | |
|---|---|---|---|
| 1142593 | 9/1957 | France | 415/146 |
| 1088813 | 9/1960 | Germany | 415/146 |

*Primary Examiner*—Edward K. Look
*Assistant Examiner*—James A. Larson
*Attorney, Agent, or Firm*—Anderson Kill Olick & Oshinsky

[57] ABSTRACT

A directional changeover pump in accordance with the present invention is capable of changing the direction of a fluid flow depending upon the rotational direction of an impeller. The directional changeover pump employs a reciprocable member for opening one discharge port and closing the other discharge port. As a result, the directional changeover pump has an extended service life and a simplified structure, since the wear of the discharge ports is automatically compensated by a spherical configuration of a reciprocating member and the sealing member between the operating components is eliminated.

1 Claim, 4 Drawing Sheets

DIRECTIONAL CHANGEOVER PUMP

FIELD OF THE INVENTION

The present invention relates to a directional changeover pump; and, more particularly, to a directional changeover pump capable of changing the direction of a fluid flow depending upon the rotational direction of an impeller therein.

DESCRIPTION OF THE PRIOR ART

Directional changeover pumps are employed to change the direction of a fluid flow with accuracy. One of such prior art directional changeover pumps is disclosed in Korean Utility Model Publication No.91-406 which utilizes a fan-shaped flap swingable between two discharge ports in the vicinity of each other. The fan-shaped flap is pivotable about a hinge depending upon the rotational direction of an impeller therein to open one discharge port and close the other discharge port. Therefore, employment of the swingable flap requires a number of sealing members on a portion formed between the discharge ports, i.e., the surface area in contact with an arc of the fan-shaped flap. However, such sealing device tends to hamper the operational performance of the pump due to the fact that the operational performance of the flap is decreased due to the friction between a sealing member and the flap. In addition, the resultant wear by the repeated operation of the swingable flap causes a shortening of the service life of the directional changeover pump.

SUMMARY OF THE INVENTION

It is, therefore, an object of the present invention to provide a directional changeover pump capable of accurately changing the direction of a fluid flow depending upon the rotational direction of an impeller.

It is another object of the present invention to provide a directional changeover pump capable of providing an extended service life by way of automatically compensating the wear and tear which may take place at the discharge ports thereof by employing a reciprocable member having a spherical configuration.

It is still another object of the present invention to provide a directional changeover pump having a simplified structure and capable of reducing the manufacturing cost by eliminating the sealing member between the operating components.

The above and other objects of the present invention are accomplished by means of a directional changeover pump for changing the direction of a fluid flow, which comprises: a main body having a pair of discharge ports in opposite relationship, a first and a second guide channels in fluid communication with the discharge ports, a hole in which a shaft of a motor is inserted, and a first guide member protruded between the guide channels; an impeller aligned with the hole to be engaged with the shaft for supplying the fluid flow to one of the guide channels depending upon the rotational direction thereof; a reciprocable member for opening one discharge port and closing the other discharge port depending upon the rotational direction of the impeller; and a cover having an inlet for supplying the fluid flow to the impeller and a second guide member incorporated with the first guide member to form a circular passageway for guiding the reciprocable member to move to and fro between the discharge ports.

BRIEF DESCRIPTION OF THE DRAWINGS

The above and other objects, advantages and features of the present invention will be apparent from the following description of preferred embodiments taken in conjunction with the accompanying drawings, wherein.

DETAILED DESCRIPTION OF THE PREFERRED EMBODIMENTS

Figure 1:
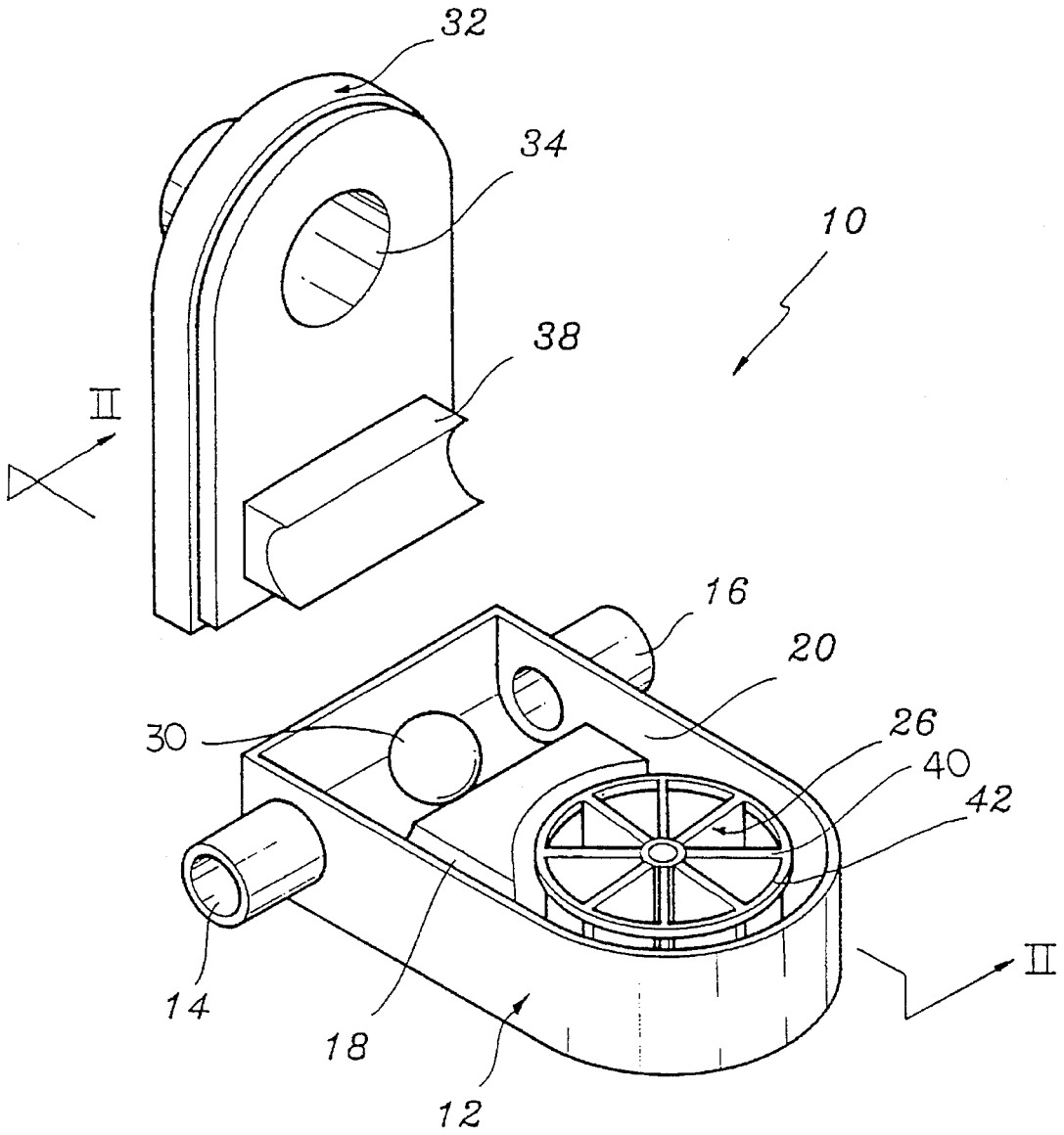
FIG. 1 is an exploded perspective view of a directional changeover pump in accordance with the present invention.
Figure 2:
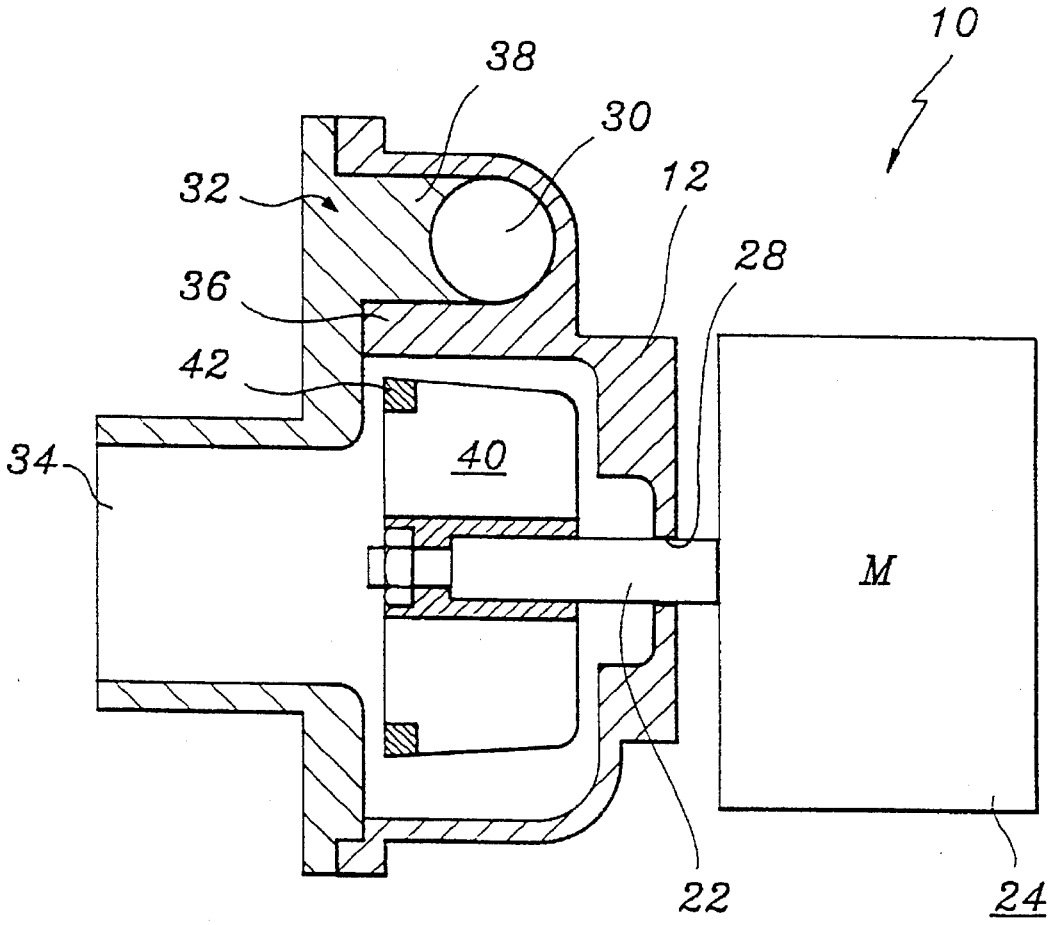
FIG. 2 is a cross-sectional view taken along line II—II shown in FIG. 1.

Referring first to FIGS. 1 and 2, there is shown a directional changeover pump in accordance with the present invention. As shown, the directional changeover pump 10 includes a main body 12 having a first and a second discharge ports 14 and 16 in opposite relationship, a first and a second guide channels 18 and 20 in communication with the discharge ports 14 and 16, respectively, a hole 28 in which a shaft 22 of a motor 24 is inserted, and a first guide member 36 protruded between the guide channels 18 and 20. An impeller 26 aligned with the hole 28 is engaged with the shaft 22 to be rotated therewith, thereby supplying a fluid flow to one of the guide channels 18 and 20. A reciprocable member, e.g., a ball 30, is movable to and fro between the discharge ports 14 and 16, and has a diameter at least larger than that of the discharge ports 14 and 16. A cover 32 has an inlet 34 for supplying a fluid flow to the impeller 26 and a second guide member 38 incorporated with the first guide member 36 to form a circular passageway, having a diameter slightly larger than that of the ball 30, for guiding the ball 30 to reciprocate between the discharge ports 14 and 16. The impeller 26 preferably has a number of radial fans 40 to provide an even flow regardless of the rotational direction thereof. An annular member 42 is integrated with the radial fans 40 to improve the structural integrity thereof, but it is not extended downward to ensure that the fluid flow supplied into the impeller is discharged to the guide channels 18 and 20 therefrom.

Figure 3:
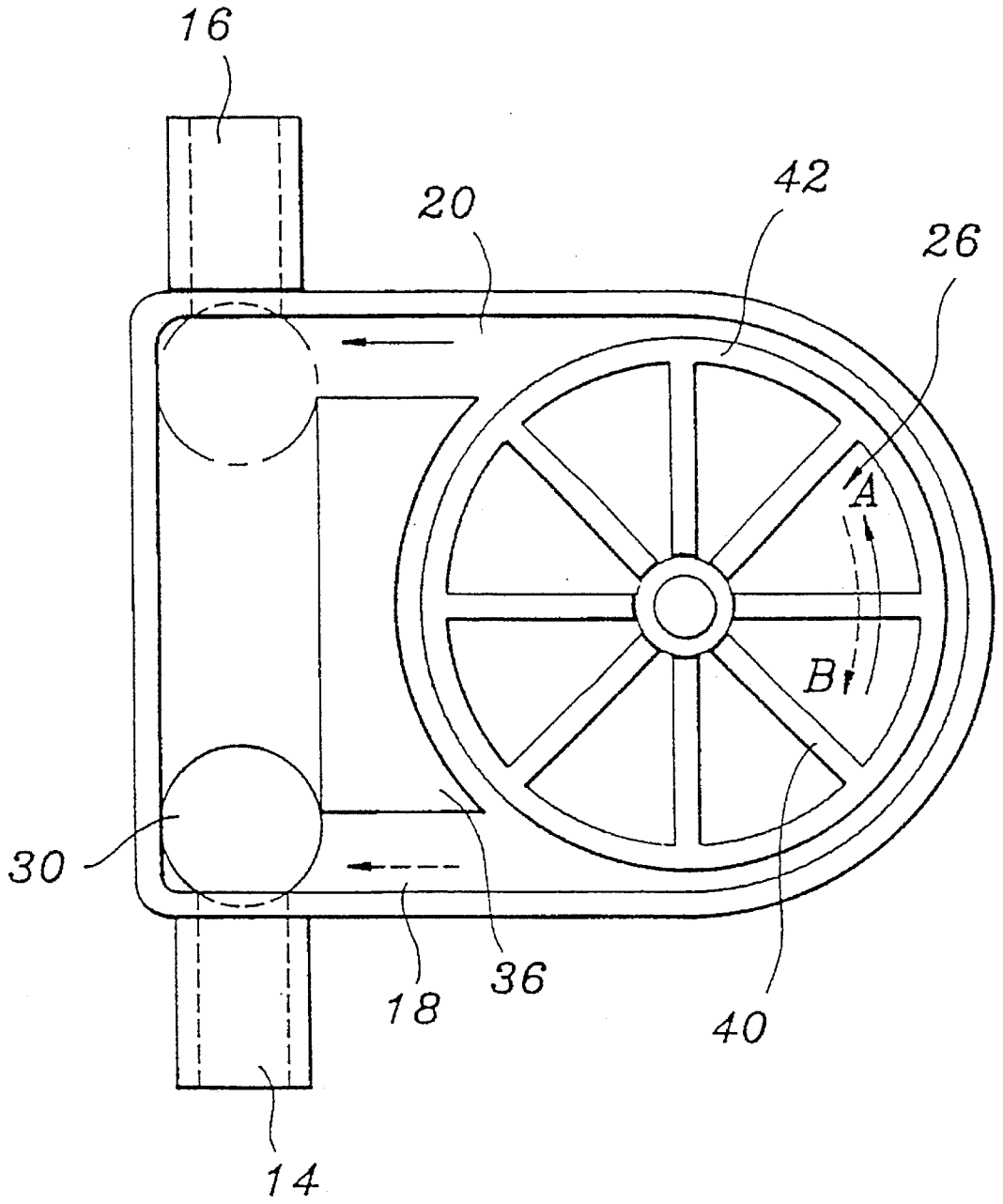
FIG. 3 is a plan view of one embodiment of the directional changeover pump shown in FIG. 1.

Referring to FIG. 3, there is shown a plan view of the main body 12, the impeller 26 and the ball 30 of the directional changeover pump 10, the cover 32 removed for description. A fluid flow supplied through the inlet 34 is pumped by the rotation of the impeller 26. First, when the impeller 26 is rotated in the direction of an arrow A (shown in solid lines), the fluid flow is supplied to the second guide channel 20 to attack an upper portion of the ball 30, thereby urging the ball 30 downward and closing the first discharge port 14, which in turn makes the fluid flow be discharged through the second discharge port 16.

On the other hand, when the impeller 26 is rotated in the direction of an arrow B (shown in broken lines), the fluid flow is supplied to the first guide channel 18 to strike a lower portion of the ball 30, thereby biasing the ball 30 upward and closing the second discharge port 16, which forces the fluid flow to be discharged through the first discharge port 14.

Additional biasing by the ensuing fluid flow causes the ball to be more closely contacted with one of the discharge ports 14 and 16 so that the sealing performance of the closed discharge port is improved. Moreover, the ball 30 is capable of accomplishing the wear compensation function since the spherical configuration of the ball 30 conforms with the wornout inner periphery of the discharge ports.

Figure 4:
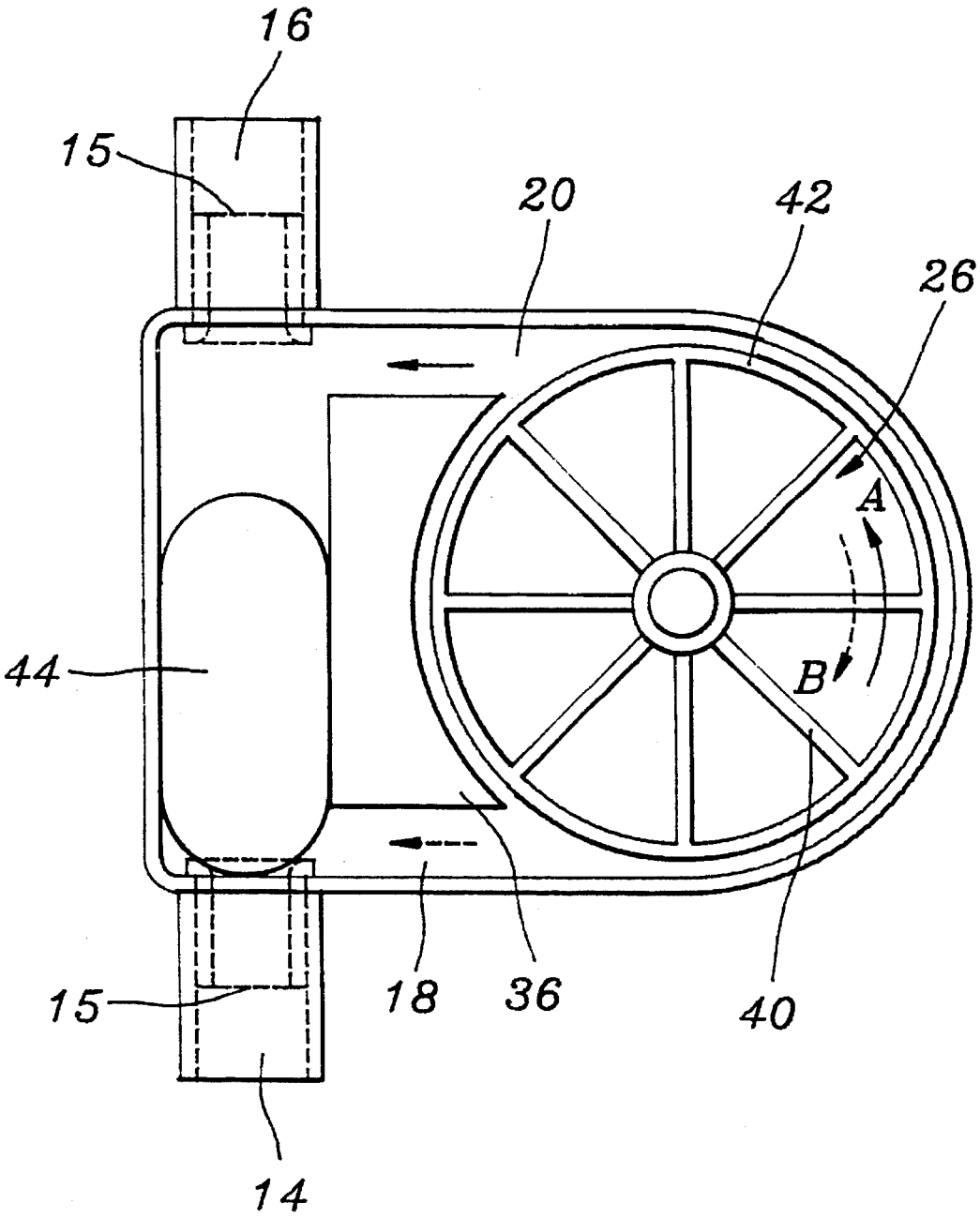
FIG. 4 is a plan view of another embodiment of the directional changeover pump in accordance with the present invention.

FIG. 4 illustrates another embodiment of the directional changeover pump. As shown, FIG. 4 is similar to that of FIG. 3, except that the reciprocable member is an elongated rod 44 provided with a pair of semi-spherical portions at its opposite ends, wherein its operational process is also similar to that of FIG. 3, except that its stroke becomes shorter. Furthermore, the directional changeover pump may preferably has a pair of rubber seals 15 inserted into the ports 14 and 16, respectively, for ensuring more reliable contact with the reciprocable member.

Although the invention has been shown and described with respect to the exemplary embodiments, it should be understood by those skilled in the art that various changes, modifications and additions may be made without departing from the spirit and scope of the invention.

What is claimed is:

1. A directional changeover pump for changing the direction of a fluid flow, which comprises:

a main body having a pair of discharge ports in opposite relationship, each of the discharge ports having a rubber seal inserted thereinto, a pair of guide channels in fluid communication with the discharge ports, a hole in which a shaft of a motor is inserted, and a first guide member protruding between the guide channels;

an impeller aligned with the hole to be engaged with the shaft for supplying the fluid flow to one of the guide channels depending upon the rotational direction thereof;

a reciprocable member having an elongated configuration provided with a pair of semi-spherical portions at its opposite ends, for opening one discharge port and closing the other discharge port depending upon the rotational direction of the impeller; and a cover having an inlet for supplying the fluid flow to the impeller and a second guide member incorporated with the first guide member to form a circular passageway for guiding the reciprocable member to move to and fro between the discharge ports.

* * * * *